US007775029B2

(12) United States Patent
Chung et al.

(10) Patent No.: US 7,775,029 B2
(45) **Date of Patent: *Aug. 17, 2010**

(54) MANUFACTURING METHOD AND APPARATUS FOR PRODUCING DIGITAL YARNS USING HYBRID METAL FOR HIGH SPEED COMMUNICATION AND DIGITAL YARNS THEREOF

(75) Inventors: Gi Soo Chung, Goyang-si (KR); Dae Hoon Lee, Seongnam-si (KR); Jae Sang An, Suwon-si (KR)

(73) Assignee: Korea Institute of Industrial Technology, Cheonan-si, Chungnam (KR)

( * ) Notice: Subject to any disclaimer, the term of this patent is extended or adjusted under 35 U.S.C. 154(b) by 107 days.

This patent is subject to a terminal disclaimer.

(21) Appl. No.: 11/986,728

(22) Filed: Nov. 26, 2007

(65) Prior Publication Data

US 2008/0182103 A1 Jul. 31, 2008

(30) Foreign Application Priority Data

Jan. 29, 2007 (KR) ..... 10-2007-0008883

(51) Int. Cl.

| | |
|---|---|
| ***D02G 3/04*** | (2006.01) |
| ***D02G 3/12*** | (2006.01) |
| ***D02G 3/36*** | (2006.01) |
| ***D02G 3/38*** | (2006.01) |

(52) U.S. Cl. ..... 57/210; 57/3; 57/232; 57/224; 428/373; 428/375; 428/377

(58) Field of Classification Search ..... 57/210, 57/224, 232, 3, 365; 428/373, 375, 377
See application file for complete search history.

(56) References Cited

U.S. PATENT DOCUMENTS

| | | | | |
|---|---|---|---|---|
| 4,813,219 | A * | 3/1989 | Rees | 57/3 |
| 6,032,450 | A * | 3/2000 | Blum | 57/75 |
| 7,135,227 | B2 * | 11/2006 | Karayianni et al. | 428/370 |
| 7,144,830 | B2 * | 12/2006 | Hill et al. | 442/205 |
| 7,365,031 | B2 * | 4/2008 | Swallow et al. | 442/181 |
| 7,504,127 | B2 * | 3/2009 | Karayianni et al. | 427/118 |
| 7,592,276 | B2 * | 9/2009 | Hill et al. | 442/301 |
| 2003/0051458 | A1 * | 3/2003 | Kim | 57/10 |

(Continued)

FOREIGN PATENT DOCUMENTS

JP 62021819 A * 1/1987

(Continued)

*Primary Examiner*—Cheryl Juska
(74) *Attorney, Agent, or Firm*—IpHorgan Ltd.

(57) ABSTRACT

A manufacturing method and apparatus for producing digital yarns using hybrid metal for high speed communication, which can be connected to a network to exchange information in real time in the ubiquitous era, and digital yarns made using the method thereof. The manufacturing method and apparatus for producing digital yarns using hybrid metal for high speed communication and digital yarns thereof comprises producing a hybrid metal rod; drawing the hybrid metal rod; producing a micro filament; feeding the micro filament; softening the micro filament; forming a sliver; forming a spun yarn; winding the spun yarn; coating the spun yarn with an electromagnetic shielding resin; drying the spun yarn with the electromagnetic shielding resin; and covering the spun yarn with a textile yarn and the digital yarn made in accordance with this method.

21 Claims, 6 Drawing Sheets

U.S. PATENT DOCUMENTS

| | | | | |
|---|---|---|---|---|
| 2004/0237494 | A1 * | 12/2004 | Karayianni et al. | 57/212 |
| 2007/0054037 | A1 * | 3/2007 | Karayianni et al. | 427/118 |
| 2008/0182103 | A1 * | 7/2008 | Chung et al. | 428/365 |
| 2009/0056300 | A1 * | 3/2009 | Chung et al. | 57/256 |
| 2009/0145533 | A1 * | 6/2009 | Karayianni et al. | 156/47 |

FOREIGN PATENT DOCUMENTS

| | | | |
|---|---|---|---|
| KR | 840593 | B1 * | 6/2008 |
| KR | 2009064637 | A * | 6/2009 |

* cited by examiner

MANUFACTURING METHOD AND APPARATUS FOR PRODUCING DIGITAL YARNS USING HYBRID METAL FOR HIGH SPEED COMMUNICATION AND DIGITAL YARNS THEREOF

STATEMENT REGARDING SPONSORED RESEARCH OR DEVELOPMENT

This work was supported by the IT R&D program of MIC/IITA. [2006-S-029-02, Design and Development of Woven UFC (Ubiquitous Fashionable Computer) Technology].

CROSS-REFERENCE TO RELATED APPLICATIONS

This application relies for priority on Korean Patent Application No. 10-2007-0008883 filed on Jan. 29, 2007, and completely incorporated by reference herein.

BACKGROUND OF THE INVENTION

1. Technical Field

The present invention relates to a manufacturing method and apparatus for producing digital yarns using hybrid metal for high speed communication and digital yarns thereof and, more particularly, to a manufacturing method and apparatus for producing digital yarns using hybrid metal for high speed communication, which can be connected to a network to exchange information in real time, and digital yarns thereof.

2. Background Art

The terminology "digital yarn" refers to yarns which can conduct electrons to transfer information as well as be woven (weaving cloth with yarn) or knitted (knitting cloth with yarn) so as to be made into clothes. Weaves or knits made of digital yarns can act as a circuit to connect electronic modules together such as a circuit board of an electronic, thereby enabling data transmission. "The Ubiquitous Era" constructs Human-centered environmental wherever human beings are. For this end, it should be possible to be connected to a network in real time anytime and anywhere to exchange necessary information. That is, this communication function is achieved in that digital garments worn by human beings are connected to a network of a computing device scattered around the surroundings in real time regardless of the recognition of human beings.

Moreover, image centered massage capable of being confirmed visually to be easily understood by anyone is transmitted in the ubiquitous era. That is, the capacity of the transmitted data enlarges, thus, the ability to process data at high speed is very important. Therefore, it is important to provide for the capability to process data at high speed into the digital garments, and a high speed communication ability and a wireless communication ability to seamlessly connect the processed data to a surrounding computing device in real time.

In order to fabricate clothes in which the computing function can be carried out, materials of the clothes capable of high speed communication seamlessly in spite of being used in the repeatedly bending part have to be produced. The materials capable of communication are conducting polymers and metals with high conductivity. The conducting polymers have high electric resistance to increasingly emit heat and consume power, thus it is not appropriate to be used for communication of digital garments. Digital yarns capable of high speed communication can be produced by drawing metal with high electrical conductivity as a core material into a micro filament. The micro filament used herein refers to a very fine metal micro-wire.

However, conventional manufacturing methods for producing digital yarns using micro filaments have several drawbacks. That is, high rigidity and brittleness of metal often breaks the metal during the process to reduce productivity, thereby raising production costs. In addition, the digital yarns tend to be broken during weaving and knitting, thereby degrading weaving and knitting efficiency. Even though the digital yarns are made into clothes, some of the digital yarns used for example in an elbow part of the clothes easily break owing to repeated bending, so that the clothes lose the communication ability. Furthermore, in view of the characteristics of metal, it is difficult to wash the clothes. Accordingly, there are real demands for advanced manufacturing methods for producing digital yarns which can overcome such problems.

SUMMARY OF THE INVENTION

It is therefore an aspect of the present invention to provide a manufacturing method for producing micro filaments using hybrid metal for high speed communication and digital yarns by using the micro filaments.

Another aspect of the present invention is to provide a manufacturing method and apparatus for producing digital yarns which can coat the micro filament with an insulating resin to improve capacity of communication, and digital yarns thereof.

Another aspect of the present invention is to provide a manufacturing method and apparatus for producing digital yarns which can improve drawability and friction characteristics of digital yarns to decrease breakage, and digital yarns thereof.

Another aspect of the present invention is to provide a manufacturing method and apparatus for producing digital yarns which can mass produce the digital yarns economically by adopting a simpler process, and digital yarns thereof.

Further another aspect of the present invention is to provide a manufacturing method and apparatus for producing digital yarns which do not easily break even if used in a repeatedly bending part such as an elbow and which can maintain a communication ability even after washed for several times, and digital yarns thereof.

In order to realize any of the foregoing aspects of the present invention, there is provided a manufacturing method for producing digital yarns using hybrid metal for high speed communication, the manufacturing method comprising the steps of: producing a hybrid metal rod; drawing the hybrid metal rod; producing a micro filament from the drawn hybrid metal rod; feeding a plurality of woven micro filaments; softening the micro filaments by heating the micro filaments; forming slivers having a predetermined length by drafting and cutting the soften micro filaments; forming a spun yarn by drawing and twisting the sliver; winding the spun yarn round a bobbin; coating the spun yarn with an electromagnetic shielding resin while unwinding the spun yarn from the bobbin; drying the spun yarn; and covering the spun yarn with a textile yarn.

In addition, the present invention includes digital yarns for communication produced by the above manufacturing method.

In order to realize any of the foregoing aspects of the present invention, there is provided a manufacturing apparatus for producing digital yarns using hybrid metal for high speed communication, the manufacturing apparatus comprising: a nozzle producing a plurality of micro filaments by drawing a hybrid metal rod comprised of a first metal part and a second metal part covering round the surface of the first metal part, the material of which is different from the first metal part; a feeding roller for feeding a plurality of micro filaments; a heating part for heating and softening the micro filaments; a stretching roller for drafting and cutting the soften micro filaments to produce slivers with a predetermined length; a spinning part for drawing and twisting the slivers to produce a spun yarn; a winding part for winding the spun yarn; a thin film coating part for thin film coating the spun yarn with a waterproof material and an electromagnetic shielding material while unwinding the spun yarn from the winding part; a drying part for drying the thin film coated spun yarn; and a covering part for covering the spun yarn with a textile yarn.

Also, in order to realize any of the foregoing aspects of the present invention, there is provided a manufacturing method for producing digital yarns using hybrid metal for high speed communication, the manufacturing method comprising the steps of: producing a hybrid metal rod; drawing the hybrid metal rod; producing a micro filament from the drawn hybrid metal rod; feeding a plurality of micro filaments; softening the micro filaments by heating the micro filaments; collecting the soften micro filaments; producing the micro filament yarns by twisting the collected micro filaments; winding the micro filament yarns round a bobbin; thin film coating the micro filament yarns with a waterproof material and an electromagnetic shielding material while unwinding the micro filament yarns from the bobbin; drying the thin film coated micro filament yarns; and covering the thin film coated micro filament yarns with a textile yarn.

In addition, the present invention includes digital yarns for communication produced by the above manufacturing method.

In order to realize any of the foregoing aspects of the present invention, there is provided a manufacturing apparatus for producing digital yarns using hybrid metal for high speed communication, the manufacturing apparatus comprising: a nozzle producing a plurality of micro filaments by drawing a hybrid metal rod comprised of a first metal part and a second metal part covering round the surface of the first metal part, the material of which is different from the first metal part; a feeding roller for feeding a plurality of micro filaments; a heating part for heating and softening the micro filaments; a collecting part for collecting the soften micro filaments; a rotating part for producing the micro filament yarns by twisting the collected micro filaments; a winding part for winding the micro filament yarns round a bobbin; a thin film coating part for thin film coating the micro filament yarns with a waterproof material and an electromagnetic shielding while unwinding the micro filament yarns from the winding part; a drying part for drying the thin film coated micro filament yarns; and a covering part for covering the micro filament yarns with a textile yarn.

The present invention provides a manufacturing method and apparatus for producing digital yarns using hybrid metal for high speed communication, which can be connected to a network to exchange information in real time in the ubiquitous era, and digital yarns thereof.

The manufacturing method for producing digital yarns using micro filaments according to the present invention can significantly decrease breakages of a filament or a spun yarn, which may take place in the manufacturing process, in order to improve productivity and save production costs.

According to the manufacturing method for producing digital yarns using micro filaments of the present invention, an additive liquid is fed in the manufacturing of the digital yarns to improve drawability and friction characteristics of the spun yarn and enhance cohesive force, thereby yielding fine yarns with a minimized cross section. Furthermore, in subsequent procedures such as knitting and weaving, breakages can be reduced.

In addition, according to the manufacturing method for producing digital yarns using micro filaments of the present invention, the digital yarns are coated with an electromagnetic shielding and a waterproof material to protect a user from electromagnetic waves when he/she wears a wearable computer made of the digital yarns. In addition, the wearable computer can be washed when soiled.

Furthermore, digital yarns produced by the manufacturing method for producing digital yarns using micro filaments of the present invention are covered by a common textile yarn. This can remove breakages owing to friction in subsequent procedures such knitting and weaving. In addition, it is also possible to produce the digital yarns with various colors by dying covering yarns.

Moreover, the manufacturing method for producing digital yarns using micro filaments according to the present invention can omit complicated procedures for producing, drawing and twisting sliver, thus mass producing the digital yarns more simply and economically.

BRIEF DESCRIPTION OF THE DRAWING FIGURES

MAJOR REFERENCE NUMERALS OF THE DRAWINGS

Figure 1:
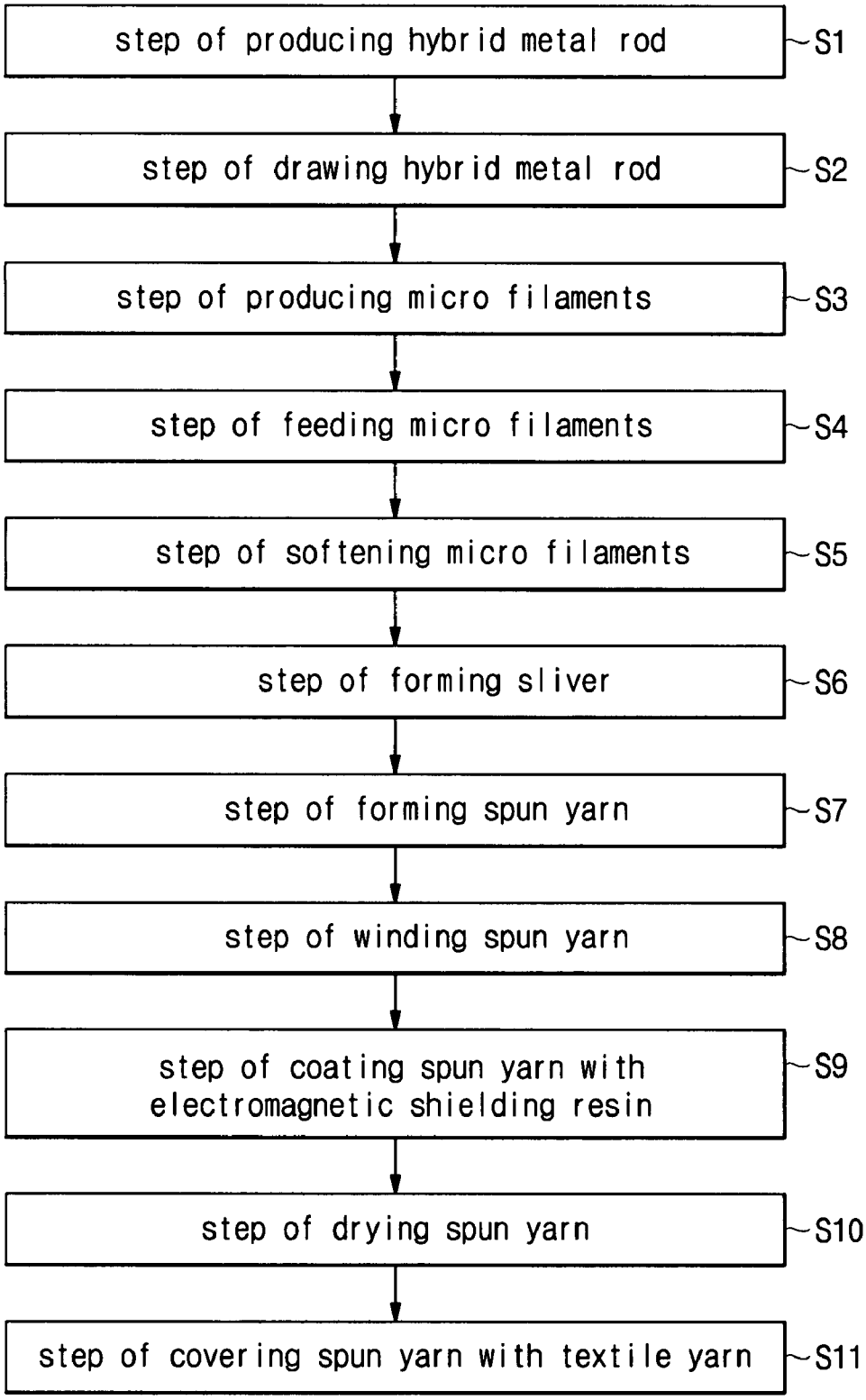
FIG. 1 is a flow chart of a manufacturing method for producing digital yarns using hybrid metal for high speed communication according to an embodiment of the present invention.

100, 110: Hybrid metal rod
101, 111: First metal part
102, 112: Second metal part
113: Third metal part
120: Nozzle

121: Nozzle inlet
123: Nozzle outlet
210, 220: Digital yarn
211, 224: Spun Yarn
212, 225: Insulating Resin
1100, 1200, 1300: Manufacturing apparatus for producing digital yarns for high speed communication according to the present invention
131: Feeding roller
132: Heating part
133: Stretching roller
134: Collecting part
135: Anti-slip roller
136: Rotating part
140: Spinning part
141: Back roller
142: Front roller
150: Winding part
151: Yarn guide
152: Bobbin
153: Traveler/ring
160: Thin film coating part
170: Drying part
180: Covering part
190: Drawing part
200: Additive liquid feeding part Hereinafter, exemplary embodiments of the present invention will be described in detail with reference to the accompanying drawings.

Figure 2:
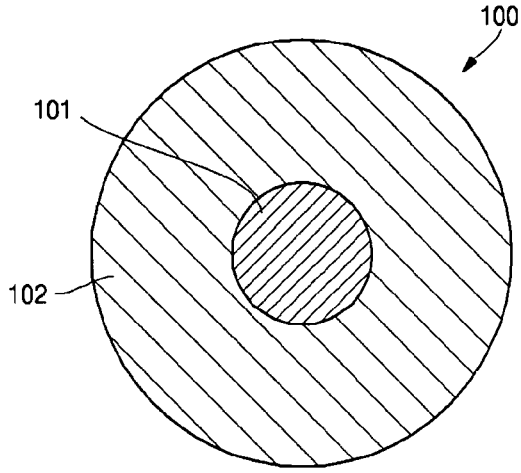
FIG. 2 and FIG. 3 are front cross sections of a structure of hybrid metal for producing digital yarns according to the present invention.
Figure 3:
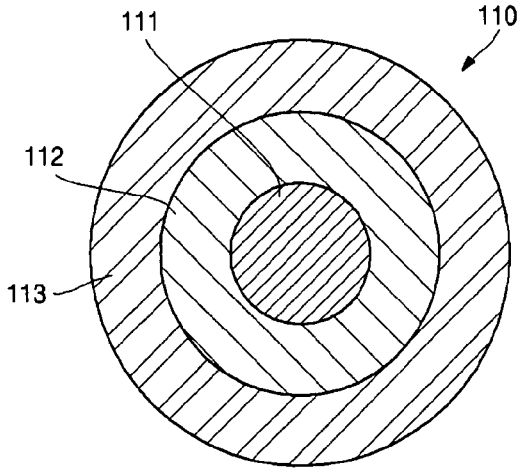
Figure 4:
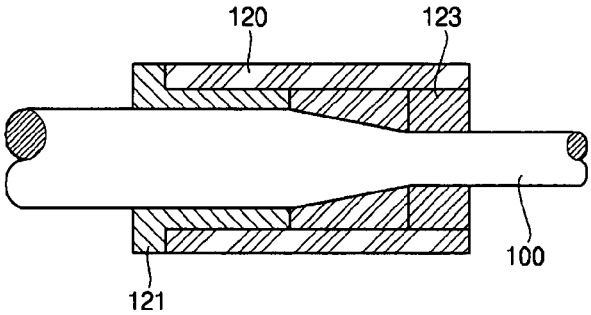
FIG. 4 is a side cross section of a nozzle used for producing digital yarns according to the present invention.
Figure 5:
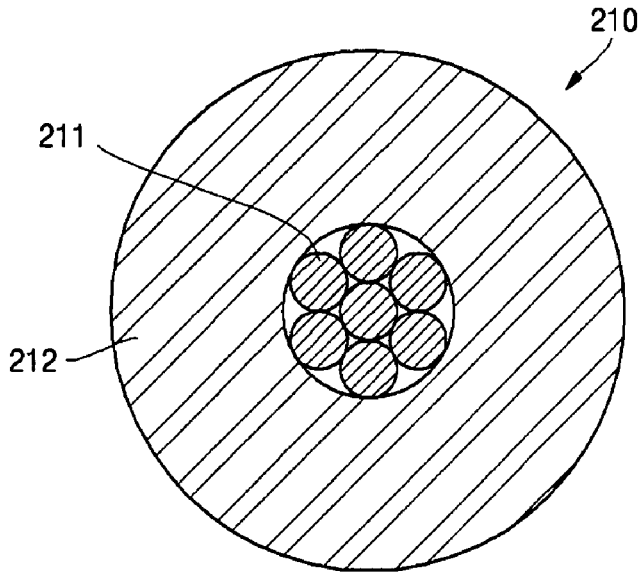
FIG. 5 and FIG. 6 are front cross sections of a structure of digital yarns using hybrid metal for high speed communication according to another embodiment of the present invention.
Figure 6:
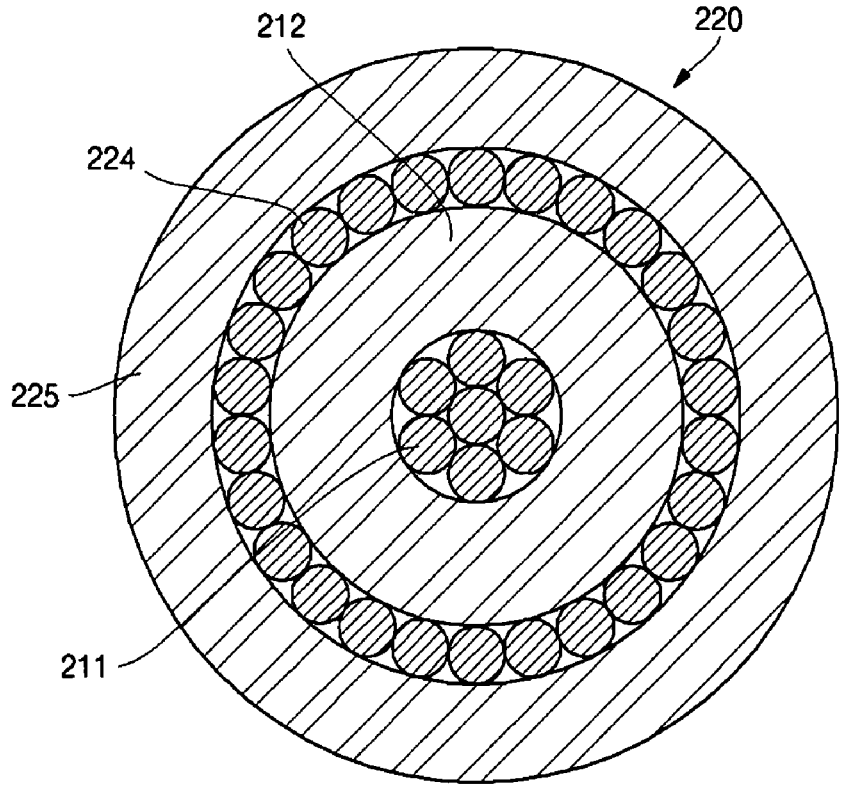

Referring to FIG. 1, a manufacturing method for producing digital yarns using hybrid metal for high speed communication according to an embodiment of the present invention is shown. Referring to FIG. 2 and FIG. 3, a structure of hybrid metal for producing digital yarns according to the present invention is shown. Referring to FIG. 4, a structure of a nozzle used for producing digital yarns according to the present invention is shown. Referring to FIG. 5 and FIG. 6, a structure of digital yarns using hybrid metal for high speed communication according to another embodiment of the present invention is shown.

Hereinafter, a manufacturing method for producing digital yarns using hybrid metal for high speed communication will be described referring to FIG. 1, FIG. 2, FIG. 3, FIG. 4, FIG. 5, and FIG. 6.

As shown in FIG. 1, a method for producing digital yarns using hybrid metal for high speed communication according to the present invention includes: a step of producing a hybrid metal rod (S1); a step of drawing the hybrid metal rod (S2); a step of producing a micro filament (S3); a step of feeding the micro filament (S4); a step of softening the micro filament (S5); a step of forming a sliver (S6); a step of forming a spun yarn (S7); a step of winding the spun yarn (S8); a step of coating the spun yarn with an electromagnetic shielding resin (S9); a step of drying the spun yarn (S10); and a step of covering the spun yarn with a textile yarn (S11).

In the step of producing a hybrid metal rod (S1), a hybrid metal rod having a predetermined length and diameter is produced. This hybrid metal rod can be made of one or more selected from a group comprising: gold, silver, brass, copper, aluminum, tin, stainless steel, steel, copper alloy, silver alloy, gold alloy, stainless alloy, tin alloy and equivalents thereof.

For example, as shown in FIG. 2, a hybrid metal rod 100 may be comprised of a first metal part 101 formed in an approximately round shape with any one selected from the above metal materials by casting and a second metal part 102 formed in an approximately round shape with a different metal material by covering round the surface of the first metal part. The first metal part 101 is preferably made of copper, brass, copper alloy and equivalents thereof which have low electric resistance and high recuperative power of elasticity while used in a repeatedly bending part, but the present invention is not limited thereto. In addition, the second metal part 102 is preferably made of silver, silver alloy and equivalents thereof which have relatively low conductivity for high speed communication, but the present invention is not limited thereto. Also, the hybrid metal rod 100 comprised of two different materials has a diameter of about 10 to 30 mm for easily producing micro filament later, but the present invention is not limited thereto.

Besides, as shown in FIG. 3, the hybrid metal rod 110 may be comprised of a first metal part 111 formed in an approximately round shape with one selected from the above metal materials by casting, a second metal part 112 formed in an approximately round shape with a different metal material by covering round the surface of the first metal part 111, and a third metal part 113 formed in an approximately round shape with a further different metal material by covering round the surface of the second metal part 112. Herein, the third metal part 113 is preferably made of gold, gold alloy and equivalents thereof which have relatively excellent conductivity for high speed communication, but the present invention is not limited thereto.

In the step of drawing the hybrid metal rod (S2), the hybrid metal rod 100 is drawn by using a nozzle 120 so as to reduce the diameter of the hybrid metal rod 100 (although the hybrid metal rod 110 can be used for description, the hybrid metal rod 100 will be described hereinafter.).

For example, as shown in FIG. 4, there is provided with a nozzle 120 an inlet 121 diameter of which and an outlet 123 diameter thereof are different from each other. While being compulsorily passed through the nozzle 120, the hybrid metal rod 100 has the same diameter as the outlet 123 diameter of the nozzle 120. The diameter ratio of the inlet to the outlet of the nozzle 120 is related with drawability of the hybrid metal. If the hybrid metal rod has high drawability, it is fine that the inlet diameter of the nozzle is longer than the outlet diameter thereof. The diameter ratio of the inlet to the outlet of the nozzle 120 can be about 1.1 to 3.5 times, but preferably about 1.1 to 1.5 times. If the diameter ratio of the inlet to the outlet of the nozzle 120 is less than 1.1 times, productivity is reduced, and if the ratio is more than 1.5 times, production cost rises.

In the step of producing a micro filament (S3), a plurality of micro filaments with a diameter of about 1 to 30 μm are produced by drawing the hybrid metal rod 100 with a diameter of about 10 to 30 mm in the constant ratio. In other words, a plurality of micro filaments are drawn as a bundle. To this end, the hybrid metal rod 100 is passed through a high temperature heated pipe before being passed through a nozzle to improve softness thereof and to reduce drawing resistance. Herein, the temperature of the heated pipe is maintained at approximately 300 to 1,200° C. (575° F.-2200° F.), but the range of temperature can be changed depending on the material of the metal and drawing ratio thereof. If the diameter of the micro filaments is less than 1,000 μm, the micro filaments can be easily broken owing to tension during the drawing process, and if the micro filaments are drawn a micro filament by a micro filament, productivity is reduced. Accordingly, it is fine for micro filaments of about 3 to 10 strands to be bound as a bundle by using adhesives, and preferably micro filament bundles of about 7 strands are proper. In addition, in order to draw the micro filaments with a desired diameter, the heating step, the drawing step, and the binding as a bundle step are repeated for about 30 to 200 times in succession. The steps may be repeated for more than 50 times so as to raise the capacity of treating surface thereof for the drawability of metal and high speed communication.

In the step of feeding the micro filaments (S4), a number of micro filaments are fed in such a fashion that the micro filaments are not cut or scattered. The linear density and fineness of the micro filaments according to the present invention can be adjusted in an appropriate range, preferably 0.001 to 0.2 g/m for the linear density and 1 to 30 μm for the fineness.

In the step of softening the micro filaments (S5), since a drafting and a cutting of the micro filaments are impossible due to large rigidity thereof, unlike common textiles, the metal structure is softened to such a degree that the micro filaments can be cut through drafting in the subsequent step. For example, the micro filaments are heated at a temperature of about 700 to 1200° for about 5 to 10 minutes.

In the step of forming a sliver (S6), the micro filaments are produced by cord-like continuous slivers. That is, the softened micro filaments are drafted and cut into the slivers having a predetermined length. In this case, the step (S6) is preferably performed with a slip-preventing step in order to prevent the micro filaments from slipping which may otherwise take place during the drafting process.

In the step of forming a spun yarn (S7), the slivers are drawn and twisted to raise the pressure among the slivers and enhance friction strength, thereby producing a spun yarn.

Before drawing the slivers, i.e., the step of forming a spun yarn (S7), it is possible to carry out an additional step of permeating additive liquid into the slivers and drying the residue of the additive liquid on the surface of the slivers. This step can maximize the collection of fibers of high surface friction coefficient before the drawing to enhance cohesive force of the fibers, thereby decreasing spinning triangle and enabling uniform drafting. As a result, this can improve strength/elongation and friction characteristics of the spun yarn to remove breakage in subsequent procedures such as knitting and weaving as well as produce fine fibers with minimized cross section owing to the maximization of their cohesive force.

Here, the term spinning triangle refers to a triangular part without twisting, formed in a range from the front roller (hereinafter, it will be explained in detail) to a point where a yarn is formed. This is caused as the twisting created in a traveler/ring is not completely transferred to the front roller. Such additive liquid may adopt all liquid materials including water. However, it is preferable to contain a small amount of a surfactant in order to improve permeation rate into fibers and uniformity.

In the step of winding the spun yarn (S8), the spun yarn is wound round a bobbin by a predetermined amount.

In the step of coating the spun yarn with the electromagnetic shielding resin (S9), the surface of the spun yarn is thin film coated with an electromagnetic shielding material and a waterproof material while unwinding the spun yarn from the bobbin under a predetermined tension. The electromagnetic shielding and waterproof materials can be adopted from any materials which have electromagnetic shielding and waterproof functions. This procedure is useful especially when the resultant digital yarns are made into clothes. That is, electromagnetic waves harmful to the human body can be shielded and, even if the clothes are washed, the washing does not impair the ability of communication through electron transfer. In order to being used particularly for high speed communication, it is very important to remove a state which data moving through the surface of a conductor get away to the outside or noise of the outside enters into the inside to cause disturbance. Insulating resins which can be used for the above objects may be any one selected from a group comprising ETFE (Ethylenetetrafluoroethylene), FEP (Fluorinated Ethylenepropylene), PTFE (Polytetrafluoroethylene), PVDF (Polyvinylidenefluoride), PFA (Perfluoroalkoxy) and equivalents thereof, but the present invention is not limited thereto.

For example, as shown in FIG. 5, an insulating resin 212 is coated in a round shape around spun yarns 211 of about 1 to 10 strands to produce a digital yarn 210 according to the present invention. The insulating resin 212 may be coated in about 10 to 500 μm thickness.

Particularly, in the case that the outside electromagnetic noise is needed to be blocked, as shown in FIG. 6, a digital resin 220 according to the present invention is produced by covering tightly the outside portion of the coated part by an insulating resin 212 with a spun yarn 224 and then coating the outside portion again with an insulating resin 225.

In the step of drying the spun yarn (S10), the coated yarn is dried so that the electromagnetic shielding resin can be excellently attached to the spun yarn.

In the step of covering the spun yarn with a textile yarn (S11), the surface of the electromagnetic shielding resin is covered by a common textile yarn. That is, the common textile yarn forms the outer surface of the digital yarn according to the present invention. With this procedures, clothes made of the digital yarns can give a wearer with a feeling the same as clothes made of the common textile yarns. This can also remove breakage owing to friction in subsequent procedures such as knitting and weaving. Examples of the common textile yarns for use in the covering may include dyed yarn, synthetic fiber or natural fiber.

In addition, the manufacturing method for producing digital yarns of the present invention may further include a procedure between the step (S6) and the step (S7) in order to improve the evenness of the slivers.

That is, several slivers produced by the step (S6) are drawn together into a thickness the same as the thickness of one original sliver through doubling and drafting. With this procedure, the evenness of the slivers can be improved.

Figure 7:
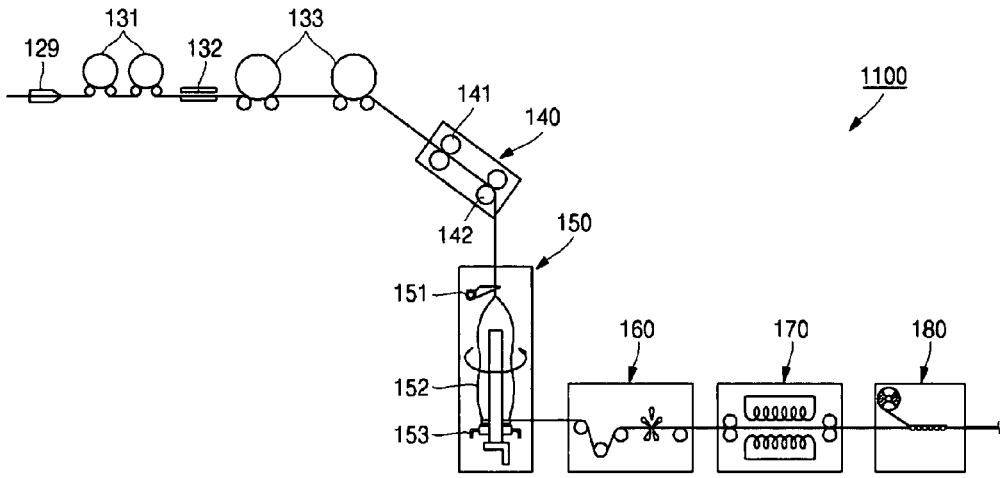
FIG. 7 is a diagrammatic view of a manufacturing apparatus for producing digital yarns using hybrid metal for high speed communication according to another embodiment of the present invention.
Figure 8:
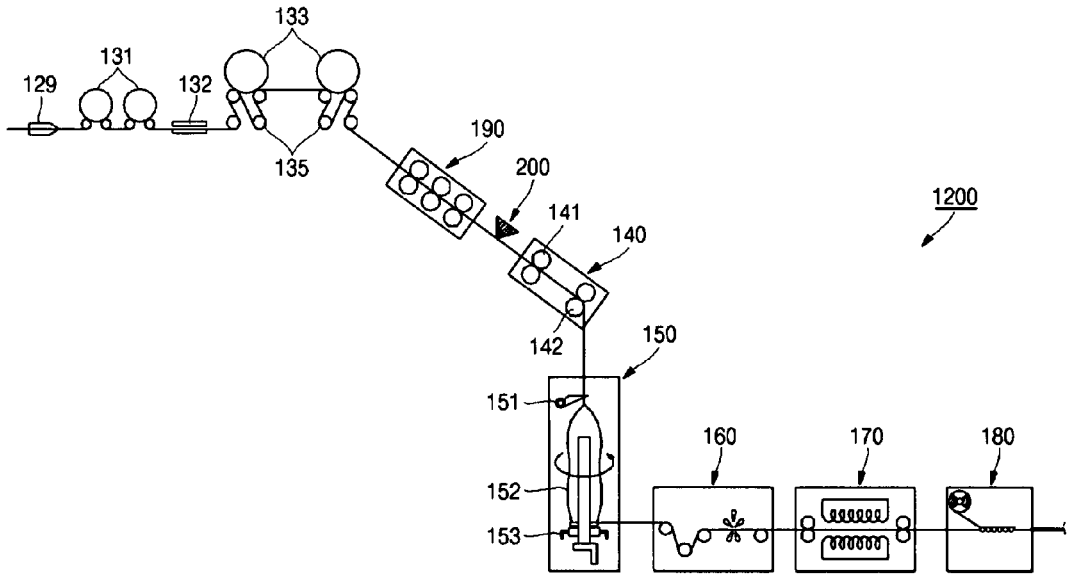
FIG. 8 is a diagrammatic view of a manufacturing apparatus for producing digital yarns using hybrid metal for high speed communication according to another embodiment of the present invention.

Referring FIG. 7 and FIG. 8, a manufacturing apparatus for producing digital yarns using hybrid metal for high speed communication according to the present invention is shown.

As shown in FIG. 7, a manufacturing apparatus for producing digital yarns for yarns using hybrid metal for high speed communication according to the present invention includes a nozzle 129, a feeding roller 131, a heating part 132, a stretching roller 133, a spinning part 140, a winding part 150, a thin film coating part 160, a drying part 170, and a covering part 180.

The nozzle 129 thinly draw a hybrid metal rod comprised of a first metal part and a second metal part covering round the surface of the first metal part, the material of which is different from the first metal part, to produce a plurality of micro filaments. The structure of the hybrid metal rod can be trip structure in addition to dual structure.

The feeding roller 131 feeds a plurality of micro filaments produced by the above manufacturing method uniformly so as not to be broken or scattered.

The heating part 132 acts to heat the micro filaments fed from the feeding roller 131 to soften structure of the metal to the extent that the micro filaments can be cut through drafting.

The stretching rollers 133 include two or more rollers, and have a higher rotation rate at an output side than at an input side, so that the micro filaments softened by the heating part 132 can be cut under the difference of rotation rates between the rollers, thereby forming slivers with a predetermined length. The slivers can be adjusted in length by adjusting the distance of the rollers because the length of the slivers is the same as the distance of the rollers.

The spinning part 140 includes a back roller 141 and a front roller 142, and draws and twists the slivers to raise the pressure among the slivers and enhance friction strength, thereby producing a spun yarn. The spinning part 140 may further include a middle roller (not shown) between the back roller 141 and the front roller 142 like a typical ring spring frame. The roller gauge, i.e. the central distance difference between roller pairs, is preferably of about 80 to 200 mm, but the present invention is not limited thereto.

The winding part 150 is a part for winding the spun yarn on the bobbin 152, and includes a yarn guide 151, the bobbin 152 and a traveler/ring 153. The yarn guide 151 functions to prevent any tangling during the winding of the spun yarn produced in the spinning part 140, the bobbin 152 is a part on which the spun yarn is wound, and the traveler rotates on the ring to wind the spun yarn on the bobbin, while creating twisting rotation to the spun yarn. The drawing and the winding are carried out by the relative movement of the traveler and the bobbin on the ring.

The thin film coating part 160 acts to coat the yarn with a thin film of an electromagnetic shielding material and a waterproof material in nanometer scale while unwinding the yarn from the bobbin under a predetermined tension. In the thin film coating part 160, about 3 to 5 spray nozzles are arranged in the form of a ring to uniformly spray the electromagnetic shielding material and the waterproof material.

The drying part 170 provides a high temperature heating zone for rapidly drying the film-coated part of the film-coated spun yarn when the film-coated spun yarn passes through the heating zone.

The covering part 180 acts to cover around the spun yarn with a common textile yarn.

In addition, as shown in FIG. 8, the manufacturing apparatus 1200 for producing digital yarns using hybrid metal for high speed communication according to another embodiment of the present invention may further include anti-slip rollers 135, a drawing part 190, and an additive liquid feeding part 200.

The anti-slip rollers 135 arranged at both sides of the stretching rollers 133, respectively, to prevent the slivers from slipping, which otherwise will slip instead of being stretched during the drafting process.

The drawing part 190 is arranged between the stretching rollers 133 and the spinning part 140 to improve the uniformity of the micro slivers through doubling, drafting and so on, by which several slivers are drawn together into a thickness the same as the original thickness of one sliver.

The additive liquid feeding part 200 is combined to the top portion of the back roller 141 of the spinning part 140 to feed additive liquid to permeate into the slivers and to dry the residue of the additive liquid on the surface of the slivers by microwave and so on.

Figure 9:
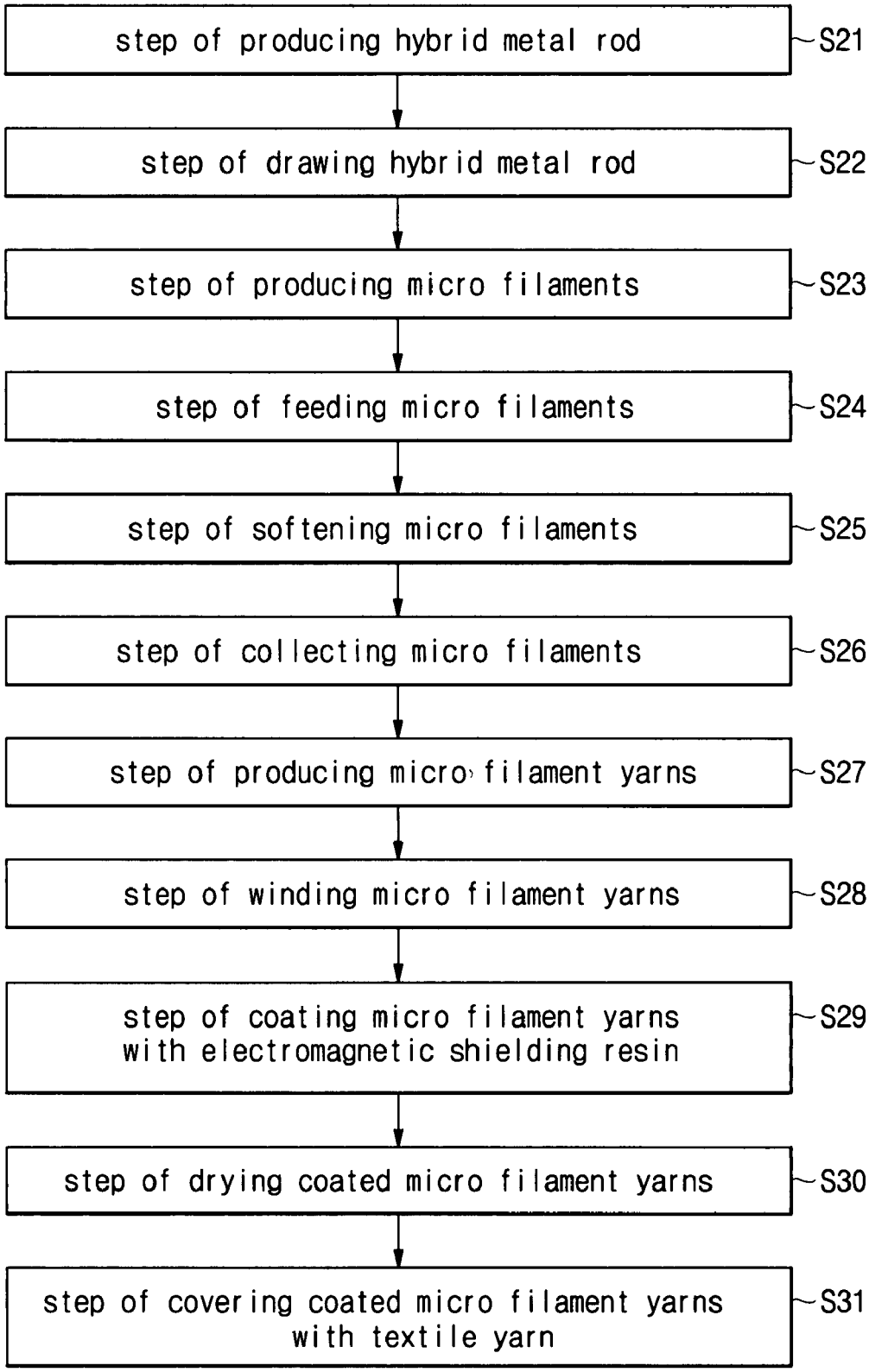
FIG. 9 is a flow chart of a manufacturing method for producing digital yarns using hybrid metal for high speed communication according to another embodiment of the present invention.

Referring to FIG. 9, a manufacturing method for producing digital yarns using hybrid metal for high speed communication according to another embodiment of the present invention is shown.

As shown in FIG. 9, there is provided a manufacturing method for producing digital yarns for high speed communication according to another embodiment of the present invention, the manufacturing method comprising the steps of: producing a hybrid metal rod (S21); drawing the hybrid metal rod (S22); producing a micro filament from the drawn hybrid metal rod (S23); feeding a plurality of micro filaments (S24); softening the micro filaments by heating the micro filaments (S25); collecting the soften micro filaments (S26); producing the micro filament yarns by twisting the collected micro filament (S27); winding the micro filament yarns round a bobbin (S28); thin film coating the micro filament yarns with a waterproof material and an electromagnetic shielding material while unwinding the micro filament yarns from the bobbin (S29); drying the thin film coated micro filament yarns; and covering the thin film coated micro filament yarns with a textile yarn (S30).

This manufacturing method for producing digital yarns using hybrid metal for high speed communication according to another embodiment of the present invention is substantially the same as the prior manufacturing method for producing digital yarns of the present invention, but differs from the prior manufacturing method in that the micro filaments are directly collected and then twisted in the steps S26 and S27 in order to produce the micro filament yarns in place of the steps S6 and S7 for drafting and cutting micro filaments for forming slivers and then drawing and heating the slivers for forming a spun yarn.

Accordingly, the manufacturing method for producing digital yarns according to another embodiment of the present invention can be used to mass produce digital yarns more simply by omitting complicated and time/cost consuming procedures of producing, drawing and twisting slivers from the actual yarn production process.

Figure 10:
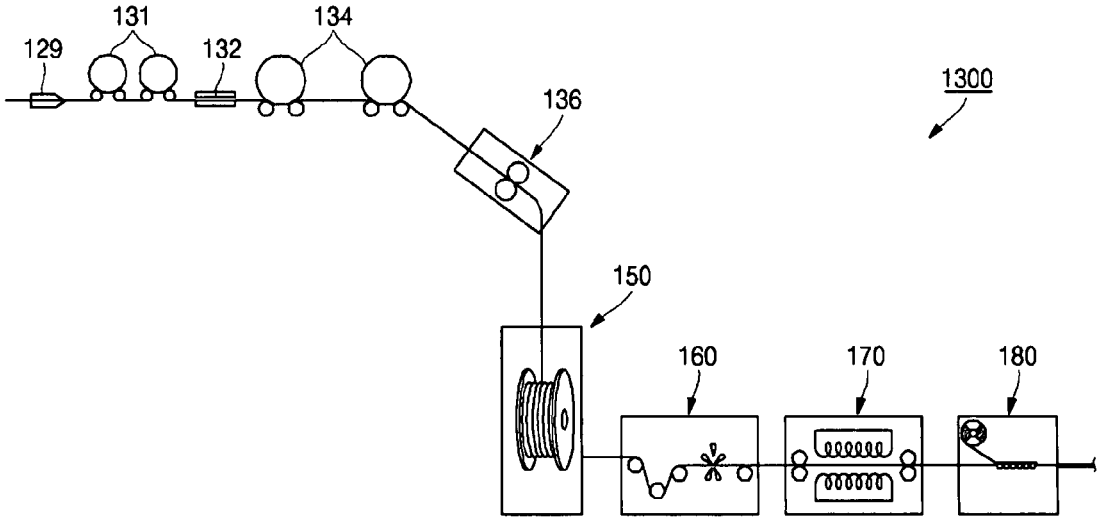
FIG. 10 is a diagrammatic view of a manufacturing apparatus for producing digital yarns using hybrid metal for high speed communication according to another embodiment of the present invention.

Referring to FIG. 10, a manufacturing apparatus for producing digital yarns using hybrid metal for high speed communication according to another embodiment of the present invention is shown.

As shown in FIG. 10, there is provided a manufacturing apparatus for producing digital yarns using hybrid metal for high speed communication according to another embodiment of the present invention, the manufacturing apparatus 1300 comprising: a nozzle 129 producing a plurality of micro filaments by drawing a hybrid metal rod comprised of a first metal part and a second metal part covering round the surface of the first metal part, the material of which is different from the first metal part; a feeding roller 131 for feeding a plurality of micro filaments; a heating part 132 for heating and softening the plurality of micro filaments; a collecting part 134 for collecting the soften micro filaments; a rotating part 136 for twisting the collected micro filaments to produce micro filament yarns 136; a winding part 150 for winding the micro filament yarns round a bobbin; a thin film coating part 160 for thin film coating the micro filament yarns with a waterproof material and an electromagnetic shielding material while unwinding the micro filament yarns from the winding part; a drying part 170 for drying the thin film coated micro filament yarns; and a covering part 180 for covering the micro filament yarns with a textile yarn.

This manufacturing apparatus according to another embodiment of the present invention is similar to the prior manufacturing apparatus described above, but differs from the prior manufacturing apparatus in that the collecting part 134 and the rotating part 136 are provided in place of the stretching rollers 133 and the spinning part 140. The collecting part 134 gathers a plurality of micro filaments as a one. Also, the rotating part 136 has an upper roller and a lower roller engaged at an angle of about 10 to 60° with the moving direction of the micro filaments, thereby enabling the micro filaments to be twisted.

What is claimed is:

1. A manufacturing method for producing digital yarns using hybrid metal for high speed communication, the manufacturing method comprising the steps of:

producing a hybrid metal rod;

drawing the hybrid metal rod;

producing micro filaments from the drawn hybrid metal rod;

feeding the micro filaments without cutting or scattering the micro filaments;

softening the micro filaments by heating the micro filaments;

forming a sliver having a predetermined length by drawing and cutting the soften micro filaments;

forming a spun yarn by drawing and twisting the sliver;

winding the spun yarn round a bobbin;

thin film coating the spun yarn with an electromagnetic shielding resin while unwinding the spun yarn from the bobbin;

drying the spun yarn; and covering the spun yarn with a textile yarn.

2. The manufacturing method for producing digital yarns using hybrid metal for high speed communication according to claim 1, wherein the hybrid metal rod is made of one or more selected from a group comprising: gold, silver, brass, copper, aluminum, tin, stainless steel, steel, copper alloy, silver alloy, gold alloy, stainless alloy, and tin alloy.

3. The manufacturing method for producing digital yarns using hybrid metal for high speed communication according to claim 1, wherein the hybrid metal rod is comprised of a first metal part formed with a predetermined metal material by casting and a second metal part formed with a different metal material by covering round the surface of the first metal part.

4. The manufacturing method for producing digital yarns using hybrid metal for high speed communication according to claim 3, wherein the hybrid metal rod has a diameter of about 10 to 30 mm.

5. The manufacturing method for producing digital yarns using hybrid metal for high speed communication according to claim 3, wherein the hybrid metal rod has a first metal part made of copper, brass or copper alloy and a second metal part made of silver or silver alloy.

6. The manufacturing method for producing digital yarns using hybrid metal for high speed communication according to claim 1, wherein the hybrid metal rod is drawn by passing through a nozzle the outlet diameter of which is relatively shorter than the inlet diameter thereof.

7. The manufacturing method for producing digital yarns using hybrid metal for high speed communication according to claim 6, wherein the diameter ratio of the inlet to the outlet of the nozzle is approximately 1.1 to 3.5 times.

8. The manufacturing method for producing digital yarns using hybrid metal for high speed communication according to claim 1, wherein the step of producing micro filaments is comprised of a step of heating the hybrid metal rod with a diameter of about 10 to 30 mm to improve the softness thereof and to reduce drawing resistance and a step of producing the micro filaments with a diameter of 1 to 30 mm by drawing the hybrid metal rod while passing through the nozzle, and the step of feeding micro filaments is to feed the micro filaments as a bundle of 3 to 10 strands.

9. The manufacturing method for producing digital yarns using hybrid metal for high speed communication according to claim 1, further comprising a step of doubling and drafting at the same time the plurality of slivers produced by the step of forming the slivers to improve the evenness of the plurality of slivers, between the step of forming the slivers and the step of forming the spun yarn.

10. The manufacturing method for producing digital yarns using hybrid metal for high speed communication according to claim 1, wherein the step of forming the slivers further comprises a slip-preventing step to prevent the micro filaments from slipping during the drafting process.

11. The manufacturing method for producing digital yarns using hybrid metal for high speed communication according to claim 1, wherein the step of forming the spun yarn further comprises a step of permeating an additive liquid into the slivers and drying the additive liquid remained on the surface of the slivers prior to the step of drawing the slivers.

12. The manufacturing method for producing digital yarns using hybrid metal for high speed communication according to claim 11, wherein the additive liquid contains a surfactant.

13. The manufacturing method for producing digital yarns using hybrid metal for high speed communication according to claim 1, wherein the step of coating the spun yarn is comprised of coating spun yarns of about 1 to 10 strands with an insulating resin in 10 to 50 mm thickness.

14. The manufacturing method for producing digital yarns using hybrid metal for high speed communication according to claim 1, further comprising a step of tightly covering the surface of the electromagnetic shielding resin with the spun yarn and then coating the spun yarn with an insulating resin.

15. The manufacturing method for producing digital yarns using hybrid metal for high speed communication according to claim 1, wherein the step of covering the spun yarn with a textile yarn is comprised of covering the surface of the electromagnetic shielding resin with a dyed yarn.

16. The manufacturing method for producing digital yarns using hybrid metal for high speed communication according to claim 1, wherein the step of covering the spun yarn with a textile yarn is comprised of covering the surface of the electromagnetic shielding resin with a natural fiber or a synthetic fiber.

17. A manufacturing method for producing digital yarns using hybrid metal for high speed communication, the manufacturing method comprising the steps of:

producing a hybrid metal rod;

drawing the hybrid metal rod;

producing micro filaments from the drawn hybrid metal rod;

feeding the micro filaments without cutting or scattering the micro filaments;

softening the micro filaments by heating the micro filaments;

collecting the soften micro filaments;

producing the micro filament yarns by twisting the collected micro filaments;

winding the micro filament yarns round a bobbin;

thin film coating the micro filament yarns with a waterproof material and an electromagnetic shielding material while unwinding the micro filament yarns from the bobbin;

drying the thin film coated micro filament yarns; and covering the thin film coated micro filament yarns with a textile yarn.

18. The manufacturing method for producing digital yarns using hybrid metal for high speed communication according to claim 17, wherein the step of covering the thin film coated micro filament yarns with a textile yarn is comprised of covering them with a dyed yarn.

19. The manufacturing method for producing digital yarns using hybrid metal for high speed communication according to claim 17, wherein the step of covering the thin film coated micro filament yarns with a textile yarn is comprised of covering them with a natural fiber or a synthetic fiber.

20. A digital yarn for high speed communication produced by a manufacturing method for producing digital yarns according to claim 1.

21. A digital yarn for high speed communication produced by a manufacturing method for producing digital yarns according to claim 17.

* * * * *